United States Patent [19]

Villeval

[11] Patent Number: 4,512,396

[45] Date of Patent: Apr. 23, 1985

[54] WATER BOX INCLUDING A DEGASSING PASSAGE, AND A HEAT EXCHANGER INCLUDING SUCH A WATER BOX

[75] Inventor: Denis Villeval, Maurepas, France

[73] Assignee: Valeo, Paris, France

[21] Appl. No.: 551,569

[22] Filed: Nov. 14, 1983

[30] Foreign Application Priority Data

Nov. 18, 1982 [FR] France ..... 82 19345

[51] Int. Cl.[3] ..... F01P 11/02; F01P 3/20

[52] U.S. Cl. ..... 165/104.32; 123/41.51; 123/41.54; 165/DIG. 24

[58] Field of Search ..... 165/104.32, DIG. 24; 123/41.54, 41.51

[56] References Cited

U.S. PATENT DOCUMENTS 4,366,858 1/1983 Movanne ..... 165/104.32

FOREIGN PATENT DOCUMENTS 2840813 1/1980 Fed. Rep. of Germany .

2483798 12/1981 France .

2492514 4/1982 France .

*Primary Examiner*—Albert W. Davis, Jr.

*Attorney, Agent, or Firm*—Dennison, Meserole, Pollack & Scheiner

[57] ABSTRACT

The invention is applicable to heat exchangers, eg. the radiator of a water-cooled internal combustion engine in a motor vehicle. Said radiator is of the type having a bundle of tubes with a water box fixed to each end thereof. One of the water boxes (20) has a passage (36) for degassing the cooling liquid. The passage comprises an internal partition (40) in the water box (20) and a conduit (50) leading to an expansion chamber (26). The water box (20), the passage partition (40) and the conduit (50) are all parts of the same single piece moulding. The expansion chamber (26) is advantageously part of the same moulding also. Effective degassing is thus provided without there being any need to add a specific degassing tube to the water box. Cost is thus reduced.

9 Claims, 7 Drawing Figures

WATER BOX INCLUDING A DEGASSING PASSAGE, AND A HEAT EXCHANGER INCLUDING SUCH A WATER BOX

The present invention relates to a water box for a heat exchanger intended for use, in particular, as a radiator in the cooling circuit of an internal combustion engine, eg. for a motor vehicle. The invention also relates a heat exchanger including such a water box.

BACKGROUND OF THE INVENTION

It is important to degas the cooling liquid in the cooling circuit of an internal combustion engine, eg. as is used in a motor vehicle. This is to prevent bubbles of gas or air collecting in the cylinder head which leads to "hot spots" that cause premature wear of the engine. The cooling liquid is usually degassed in the heat exchanger which constitutes the radiator of the cooling circuit. When the radiator is of the type comprising a bundle of parallel tubes running between water boxes fitted at each of their ends, the bubbles of air or gas present in the cooling liquid collect in the top of one of the water boxes, and in general in the water box which does not include the liquid inlet tube to the heat exchanger. Degassing is performed bymeans of a degassing conduit or passage having one end opening out into said top part of said water box where the bubbles of air or gas collect, and having its other end connected to an expansion chamber which is associated with the heat exchanger. The reduced pressure in the expansion chamber sucks the collected bubbles of air or gas from the top of the water box into the expansion chamber.

A first way of forming degassing passages or conduits is simply by providing a hole through a partition wall which separates the water box from the expansion chamber, provided they are side by side in the same housing. A second, and preferred way, is by providing a short length of tube which is fixed in the water box by any suitable means and which has its top end opening out into the space where bubbles of gas or air collect while its bottom end opens out into the expansion chamber below the level of the cooling liquid under normal operating conditions. The second way avoids air or gas being returned to the cooling circuit when the engine is stopped.

However, placing and fixing a degassing tube in a heat exchanger complicates assembly thereof and increases its cost.

Preferred embodiments of the present invention avoid this drawback in a simple and cheap manner.

SUMMARY OF THE INVENTION

The present invention provides a water box for a heat exchanger suitable for use as the radiator in a cooling circuit of an internal combustion engine, the water box including a passage for degassing the cooling liquid, said passage opening out near to one end of the water box and being intended for connection to an expansion chamber which is associated with the heat exchanger, the improvement wherein the water box is made of a single piece moulding with the degassing passage being formed between a wall of the water box and an internal partition inside the water box running parallel to said wall and forming a part of the same single piece moulding as the rest of the water box.

Thus, in accordance with the invention, a degassing passage is formed in a heat exchanger water box by being part of the same moulding as the rest of the water box and without requiring any additional parts to be placed thereon and fixed thereto. In other words, the water box is obtained in a single moulding complete with integral degassing passage and can be mounted directly onto a heat exchanger.

The invention also provides a heat exchanger comprising a bundle of tubes through which a heat exchanger liquid flows, together with water boxes mounted at each end of the bundle, wherein one of the water boxes is of the above-defined type.

The invention can be applied to heat exchangers having various types of flow path (eg. "I" type, "U" type or "Z" type), and is particularly applicable to heat exchangers having horizontal tubes.

Thus, in a general manner, the invention facilitates fabrication and assembly of a motor vehicle heat exchanger which uses a liquid coolant and degasses it, thereby reducing the cost of the heat exchanger.

BRIEF DESCRIPTION OF THE DRAWINGS

Embodiments of the invention are described by way of example with reference to the accompanying drawings, in which.

MORE DETAILED DESCRIPTION

Figure 2:
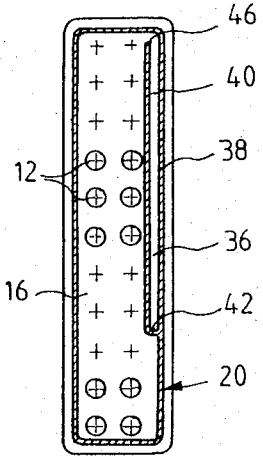
FIG. 2 is a section on a line II—II of FIG. 1.
Figure 1:
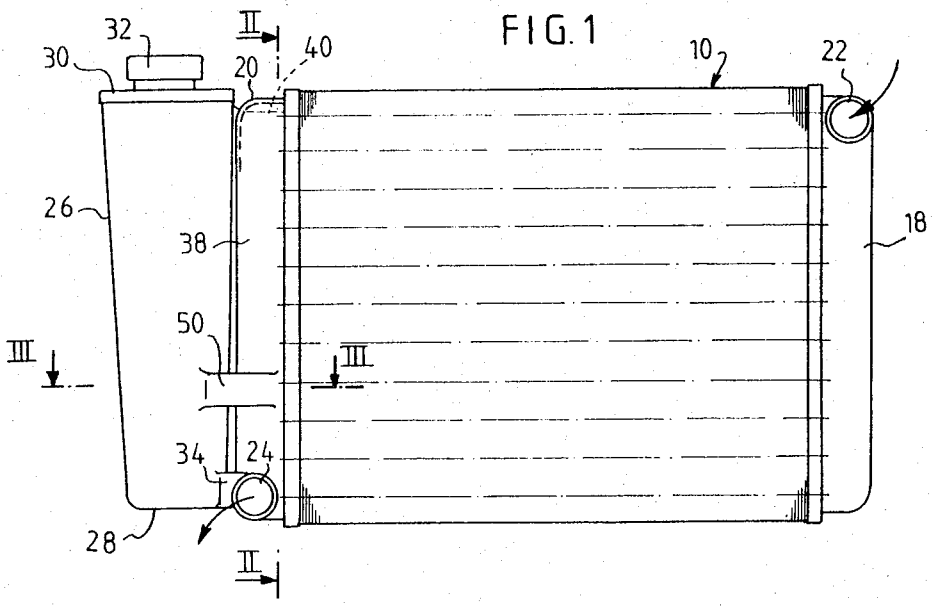
FIG. 1 is an elevation of a first embodiment of the a heat exchanger in accordance with the invention.
Figure 3:
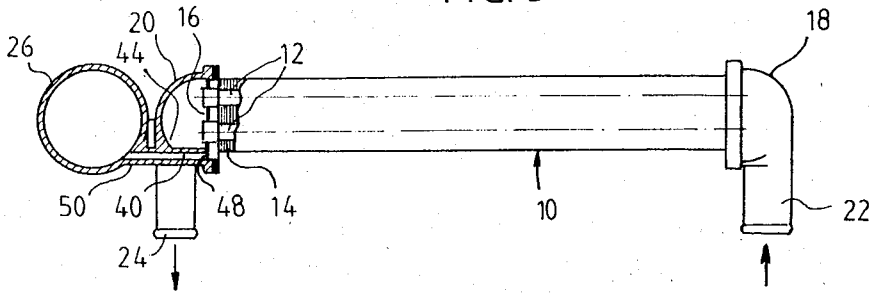
FIG. 3 is a plan view of the FIG. 1 heat exchanger, partially cut away on a line III—III.
Figure 6:
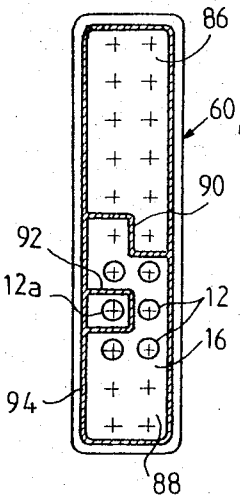
FIGS. 5 and 6 are sections on lines V—V and VI—VI respectively in FIG. 4.
Figure 4:
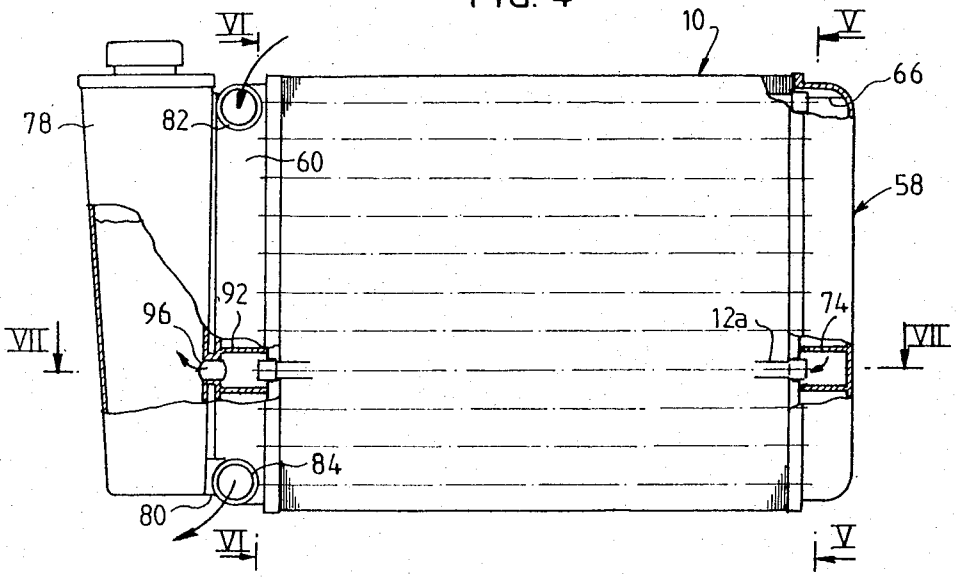
FIG. 4 is a partially cut away elevation of a second embodiment of a heat exchanger in accordance with the invention.
Figure 7:
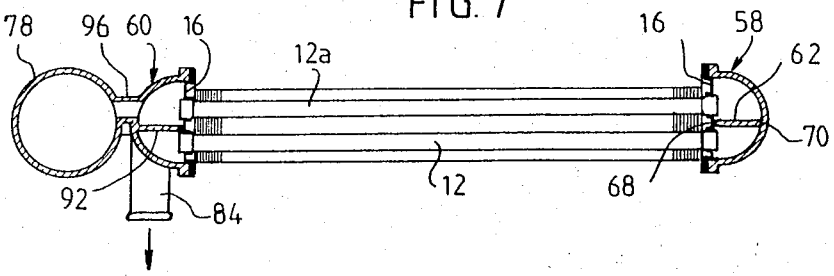
FIG. 7 is a section seen from above on a line VII—VII of FIG. 4.
Figure 5:
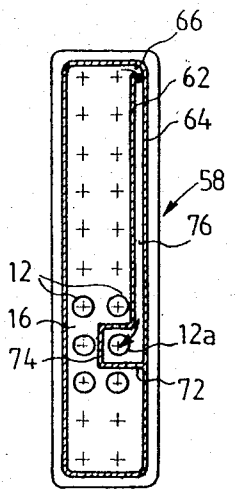

Reference is made initially to FIGS. 1 to 3 which show diagramatically a first embodiment of a heat exchanger in accordance with the invention.

The heat exchanger shown in these figures comprises, in conventional manner, a bundle 10 of horizontal tubes 12 for liquid circulation. The tube 12 are rectilinear, parallel to one another, and disposed in two planes. The tubes 12 are fitted with transverse fins 14 over the major portion of their length, while their ends are fitted in sealed manner into holes in respective perforated plates 16. First and second water boxes 18 and 20 are mounted in conventional manner on the perforated plates 16. The first water box 18 is mounted on the right hand end of the bundle 10 as shown in FIG. 1, and has an inlet tube 22 located near to its top for admitting cooling liquid into the heat exchanger. The second water box 20 at the other end of the bundle 10 has an outlet tube 24 located near the bottom thereof and through which cooling liquid leaves the heat exchanger. The cooling liquid thus arrives in the first water box 18 via the inlet tubing 22, flows along the tubes 12 of the bundle 10, enters the second water box 20 and leaves the heat exchanger via the outlet tubing 24. The liquid flows in the same direction along all the tubes 12, and the heat exchanger is thus of the "I" flow type.

In this embodiment, the water box 20 is obtained in a single piece moulding together with an associated expansion chamber 26 which is generally frusto-conical in shape having a small bottom plate 28 which is part of the mulding and a larger top plate 30 which is added on to the moulding. The top plate 30 has a filler inlet 32 for the cooling circuit as a whole. The second water box 20 and the expansion chamber 26 are interconnected by a conduit 34 which is located near the bottom of both items and which is formed as part of the same single piece moulding. The expansion chamber 26 and the second water box 20 may be mechanically interconnected over the greater part of their height by a thin strip or spine also forming part of the same single piece moulding.

In accordance with the invention, a degassing passage 36 is formed in the second water box 20 between a longitudinal or vertical wall 38 thereof and an internal partition 40 which forms part of same moulding as the water box. The internal partition 40 is substantially plane and extends from about one fourth to one third of the way up the inside of the second water box 20 to close to the top edge thereof (see FIG. 2).

More precisely, the internal partition 40 is in the form of a rectangular plane and is connected to the walls of the water box 20 along a bottom transverse edge 42 and along a vertical or longitudinal edge 44. Its top transverse edge 46 remains free near to the top of the second water box 20, and the other longitudinal or vertical edge 48 is also free (see FIG. 3) and runs substantially along the plane of the open face of the water box 20 where it receives the perforated plate 16. The bottom end of the degassing passage 36 made in this way between the internal partition 40 and the longitudinal wall 38 of the water box is connected to the inside volume of the expansion chamber 26 by an external conduit 50 which is obtained as part of the same single piece moulding as the expansion chamber 26 and the water box 20.

In operation, bubbles of air or gas transported by the liquid collect in the top of the water box 20, whence they are sucked via the degassing passage 36 into the expansion chamber because of the relatively lower pressure to be found in the expansion chamber 26. The external conduit 50 interconnecting the degassing passage 36 and the expansion chamber 26 opens out below the level of the liquid contained in the expansion chamber during normal operation, thereby avoiding any air or gas being taken back into the cooling liquid when the associated motor is stopped.

Furthermore, the external link conduit 50 opens out into the expansion chamber 26 at a sufficient distance from the bottom link conduit 34 to ensure that bubbles of air or gas arriving in the expansion chamber 26 via the conduit 50 are not recycled into the cooling liquid by being sucked into water box 20 via the bottom conduit 34.

Reference is now made to FIGS. 4 to 7 which show a second embodiment of the invention in which the heat exchanger has "U" type liquid flow.

In this case, the bundle 10 of the heat exchanger is identical to the bundle 10 of the FIG. 1 heat exchanger, and it is likewise fitted between first and second water boxes 58 and 60 with the ends of the tubes 12 in the bundle being fixed in sealed manner in holes through respective perforated plates 16. Unlike the FIG. 1 embodiment, the first water box 58 does not have either an inlet tube nor an outlet tube, but it does have an internal partition 62 which forms part of the same single piece moulding as the rest of the first water box 58. This partition 62 extends substantially parallel to the longitudinal wall 64 of the first water box 58 at a small distance therefrom. The internal partition 62 has a free transverse edge 66 close to the top of the water box 58, a free longitudinal edge 68 which is pressed in substantially sealed manner to the corresponding perforated plate 16, a longitudinal edge 70 which is moulded to a far line along the semicylindrical wall of the water box 58, and a bottom transverse edge 72 which is moulded to the longitudinal wall 64 of the water box. Further, the bottom end of the partition 62 has a projecting U-shaped portion 74 which surrounds in substantially sealed manner the end of one of the tubes 12*a* in the bundle 10. The internal partition 62 and the longitudinal wall 64 of the water box 58 delimit between them a degassing passage 76 which connects the top of the water water box 58 to the tube 12*a*.

The second water box 60 at the other end of the bundle 10 is obtained from a single piece moulding which includes an expansion chamber 78 as in the FIG. 1 embodiment. It communicates with the expansion chamber via a bottom suction conduit 80 which is likewise part of the same one piece moulding as the expansion chamber and the water box.

The top of the second water box 60 has an inlet tube 82 for admitting cooling liquid into the heat exchanger, and a botton outlet tube 84 via which cooling liquid leaves the heat exchanger. The inside volume of the second water box 60 is divided into upper and lower compartments 86 and 88 respectively by a transverse internal partition 90 which is part of the same one piece moulding as the rest of the water box. The inlet tube 82 leads to the upper compartment 86, while the lower compartment 88 leads to the outlet tube 84.

Below the internal partition 90, the water box 58 has a second internal partion 92 which is U-shaped and which is part of the same one piece moulding as the rest of the water box. The U-shaped partition 92 which is moulded to a longitudinal wall 94 of the water box, surrounds in substantially sealed manner the other end of the tube 12*a* leading to the degassing passage 76. A link conduit 96 is provided between the water box 60 and the expansion chamber78, again as part of the same one piece moulding, to interconnect the portion of the second water box 60 which is cut off by the U-shaped partition 92 to the expansion chamber. This conduit 96 thus connects the expansion chamber 78 to the tube 12*a* in the bundle 10, and thence to the degassing passage 76 in the first water box 58.

In operation, bubbles of gas or air entrained by the cooling liquid enter the heat exchanger via the inlet tube 82 and tend to collect in the top of the first water box 58 whence they are sucked into the degassing passage 76, along the tube 12*a* through the bundle 10 and through the conduit 96 to reach the expansion chamber 78 below the level of liquid contained therein during normal operating conditions.

The two embodiments which have been described with reference to FIGS. 1 to 3 and to FIGS. 4 to 7 respectively are applicable to "I" type and to "U" type flow heat exchangers respectively. The invention is also applicable to heat exchangers using a "Z" type flow, in which case an internal partition of the same type as the partition 90 in FIG. 6 should be fitted to both the first and the second water boxes of the FIG. 1 embodiment. This partition should be about two thirds of the way up the first water box 18 and about one third of the way up the second water box 20.

The invention is thus applicable to providing a degassing passage in a heat exchanger suitable for preventing air being taken back into the cooling circuit when the engine is stopped and regardless of the type of flow path (I, U or Z) followed by the cooling liquid through the heat exchanger. No extra parts need to be added to the mouldings from which the waer boxes are made in order to obtain the required degassing passage.

I claim:

1. In a water box for a heat exchanger suitable for use as the radiator in a cooling circuit of an internal combustion engine and which is formed from a bundle of tubes having a perforated plate at at least one end of said bundle, the perforated plate forming a transverse wall between said water box and the bundle of tubes, and the perforations of said plate forming passages between the tubes of the bundle and the water box, wherein said water box includes a passage for degassing a cooling liquid contained therein, said passage opening out near to one end of the water box and being intended for connection to an expansion chamber which is associated with the heat exchanger, the improvement comprising forming the water box of a single piece molding comprising an internal partition inside the water box which is a part of said single piece molding, and which is parallel to a longitudnal wall of the water box, the degassing passage being formed between said internal partition and said longitudinal wall, wherein said internal partition includes a free longitudinal edge which is pressed to said perforated plate in a substantially sealed manner, an opposite longitudinal edge which is connected to a wall of said water box, a transverse edge which is free and which is located near to said one end of said water box, and a transverse edge which is connected to a wall of said water box.

2. A water box according to claim 1, comprising a single piece moulding having an external conduit opening out into the water box in its degassing passage close to where a transverse edge of the internal partition runs into the wall of said water box.

3. A water box according to claim 2, wherein the water box is obtained as part of a single piece moulding which includes an expansion chamber and said external conduit, said external conduit connecting the degassing passage to the expansion chamber.

4. A water box according to claim 1, wherein said internal partition includes a projecting portion suitable for fitting round a first end of one of the tubes in the heat exchanger bundle of tubes, whereby said tube opens out into the degassing passage in said water box.

5. A heat exchanger including a bundle of tubes through which a liquid flows and two water boxes, one at each end of the bundle, wherein one of said water boxes is a water box according to claim 1.

6. A heat exchanger according to claim 5, wherein said water box includes an outlet tube for liquid leaving the heat exchanger and wherein the other water box includes an inlet tube for admitting liquid to the heat exchanger.

7. A heat exchanger including a bundle of tubes through which liquid flows, and at least one water box mounted on one end of the bundle, wherein said water box is a water box according to claim 4.

8. A heat exchanger according to claim 7, including a second water box which is associated with an expansion chamber and which is made from a single piece moulding therewith, said second water box having an internal partition surrounding the other end of said one of the tubes in the bundle whose first end opens out into the degassing passage in the first water box, said partition connecting said one tube to the expansion chamber via a conduit, forming part of said single piece moulding.

9. A heat exchanger according to claim 8 or according to claim 7 and including a second water box, wherein the second water box has an inlet tube and an outlet tube for the heat exchanger liquid and wherein the second water box is divided into first and second compartments by a transverse internal partition, the inlet tube opening out into one of said compartments and the outlet tube opening out into the other of said compartments.

* * * * *